US011508319B2

(12) United States Patent
Kim et al.

(10) Patent No.: US 11,508,319 B2
(45) Date of Patent: Nov. 22, 2022

(54) SOURCE DRIVER AND DISPLAY DEVICE INCLUDING THE SAME

(71) Applicant: Silicon Works Co., Ltd., Daejeon (KR)

(72) Inventors: Won Kim, Daejeon (KR); Young Bok Kim, Daejeon (KR)

(73) Assignee: Silicon Works Co., Ltd, Daejeon (KR)

( * ) Notice: Subject to any disclaimer, the term of this patent is extended or adjusted under 35 U.S.C. 154(b) by 0 days.

(21) Appl. No.: 17/459,948

(22) Filed: Aug. 27, 2021

(65) Prior Publication Data

US 2022/0068223 A1 Mar. 3, 2022

(30) Foreign Application Priority Data

Aug. 31, 2020 (KR) ..... 10-2020-0109882

(51) Int. Cl.
*G09G 3/3291* (2016.01)

(52) U.S. Cl.
CPC ... *G09G 3/3291* (2013.01); *G09G 2300/0842* (2013.01); *G09G 2310/0291* (2013.01); *G09G 2310/08* (2013.01); *G09G 2320/0233* (2013.01); *G09G 2320/0261* (2013.01); *G09G 2320/0295* (2013.01)

(58) Field of Classification Search
CPC .. G09G 3/3233; G09G 3/3648; G09G 3/3688; G09G 3/3696; G09G 3/3291; G09G 3/3266; G09G 3/20; G09G 2300/0819; G09G 2300/0852; G09G 2300/0842; G09G 2300/0426; G09G 2320/043; G09G 2320/0233; G09G 2310/061
See application file for complete search history.

(56) References Cited

U.S. PATENT DOCUMENTS

2007/0057882 A1* 3/2007 Hashimoto ..... G09G 3/3685 345/88
2011/0227505 A1* 9/2011 Park ..... H05B 45/60 315/297
2014/0176516 A1* 6/2014 Kim ..... G09G 3/3233 345/204
2021/0287608 A1* 9/2021 Min ..... G09G 3/3291
2021/0358430 A1* 11/2021 Huang ..... G09G 3/3688

FOREIGN PATENT DOCUMENTS

KR 2020-0057295 A 5/2020

* cited by examiner

*Primary Examiner* — Dong Hui Liang
(74) *Attorney, Agent, or Firm* — Polsinelli PC

(57) ABSTRACT

A source driver capable of improving sensing accuracy even when a black image signal is provided to reduce motion blur during a sensing period for sensing signals of pixels of a display panel, and a display device including the same. The source driver includes an output buffer configured to output a source signal; a voltage terminal applied with a black image signal of a preset voltage level; a source output terminal connected to a data line of a display panel; and a switch circuit configured to connect one of an output terminal of the output buffer and the voltage terminal to the source output terminal, wherein the switch circuit connects the voltage terminal to the source output terminal during a black image insertion period of a sensing period in which a pixel of the display panel is sensed.

15 Claims, 3 Drawing Sheets

SOURCE DRIVER AND DISPLAY DEVICE INCLUDING THE SAME

BACKGROUND

1. Technical Field

Various embodiments generally relate to a display device, and more particularly, to a source driver having a black image insertion function and a display device including the same.

2. Related Art

As the information society develops, various demands for display devices for displaying an image are increasing, and various types of display devices such as a liquid crystal display device and an organic light emitting display device are being utilized.

Among these display devices, the organic light emitting display device uses an organic light emitting diode which emits light by itself, and thus, has a fast response speed and provides advantages in terms of contrast ratio, luminous efficiency, luminance and viewing angle.

Such an organic light emitting display device includes an organic light emitting diode which is disposed in each of a plurality of pixels arranged in a display panel, and may display an image by controlling the luminance of each of the pixels through control of a current flowing through the organic light emitting diode.

In such an organic light emitting display device, motion blur may occur. The motion blur means a phenomenon in which an image is partially blurred depending on a moving speed of an object included in the image, due to a limitation in response speed in the process of displaying the image on the display panel.

Recently, in order to reduce the motion blur of the organic light emitting display device, a black data insertion technology is applied. The black data insertion technology is to insert a black image between driving images. To this end, black data for representing the black image may be inserted between display data which represent the driving images.

In the organic light emitting display device, the organic light emitting diode and a driving transistor for driving the organic light emitting diode may be disposed in each of the pixels of the display panel. A characteristic value of each of the pixels, such as a threshold voltage or a mobility of the driving transistor, may vary depending on a usage time, and deviations may occur in characteristic values of the pixels due to differences in usage time among the pixels. Due to this fact, deviations in luminance may occur among the pixels.

In order to solve the deviations in luminance among the pixels, the organic light emitting display device is configured to sense and compensate for deviations in characteristic values of the pixels.

Characteristic values of the pixels may be sensed by a sensing circuit of a source driver, and compensation of display data for solving the deviations in characteristic values may be performed by a timing controller. However, when a sensing error occurs due to an unexpected reason, there is a problem in that an abnormal phenomenon occurs in a display image.

The sensing error may occur by the transition of a source signal by black data when the black data is inserted during a sensing period for sensing characteristic values of the pixels. That is to say, a problem may arise in that noise caused by the transition of the source signal is introduced into the sensing circuit of the source driver.

In addition, characteristic values of the pixels have sensing deviations according to a case in which black data is inserted during the sensing period and a case in which no black data is inserted during the sensing period.

SUMMARY

Various embodiments are directed to providing a source driver in which a black image signal for reducing motion blur may be provided without causing noise during a sensing period for sensing characteristic values of pixels of a display panel, thereby improving sensing accuracy, and a display device including the same.

In an embodiment, a source driver may include: an output buffer configured to output a source signal; a voltage terminal applied with a preset voltage level; a source output terminal connected to a data line of a display panel; and a switch circuit configured to connect one of an output terminal of the output buffer and the voltage terminal to the source output terminal, wherein the switch circuit connects the voltage terminal to the source output terminal during a black image insertion period of a sensing period in which a pixel of the display panel is sensed.

In an embodiment, a display device may include: a display panel; and a source driver configured to provide a source output to a pixel of the display panel, wherein the source driver provides the source output for displaying a driving image with a black image inserted therein, and wherein during a black image insertion period of a sensing period in which the pixel of the display panel is sensed, the source driver outputs a preset voltage level for displaying the black image, as the source output.

According to the embodiments, a source driver may insert a black image signal for reducing motion blur while maintaining a level of a source signal during a sensing period.

According to the embodiments, even when the black image signal is inserted, the transition of the source signal in the source driver may be prevented. Thus, it is possible to prevent noise from being introduced into a sensing circuit of the source driver which senses characteristic values of pixels during the sensing period.

Also, according to the embodiments, as the transition of the source signal in the source driver is prevented during the sensing period, sensing deviations in characteristic values of the pixels between the sensing period in which no black image signal is inserted and the sensing period in which the black image signal is inserted may be reduced, which makes it possible to improve sensing accuracy.

Further, according to the embodiments, since it is unnecessary to provide black data for insertion of a black image, a process for a timing controller to control the source driver may be simplified.

DETAILED DESCRIPTION

Embodiments disclose a source driver capable of improving sensing accuracy even when a black image is inserted between driving images in order to reduce motion blur.

In the embodiments, a display period may be defined as a period in which a source signal corresponding to display data is outputted as a source output to a display panel. The source signal is a signal which is outputted from an output buffer, to be described later, in the source driver, and the source output is a signal which is outputted through a source signal output terminal of the source driver.

In the embodiments, a sensing period may be defined as a period in which a sensing circuit of the source driver senses characteristic values of pixels of the display panel.

Figure 2:
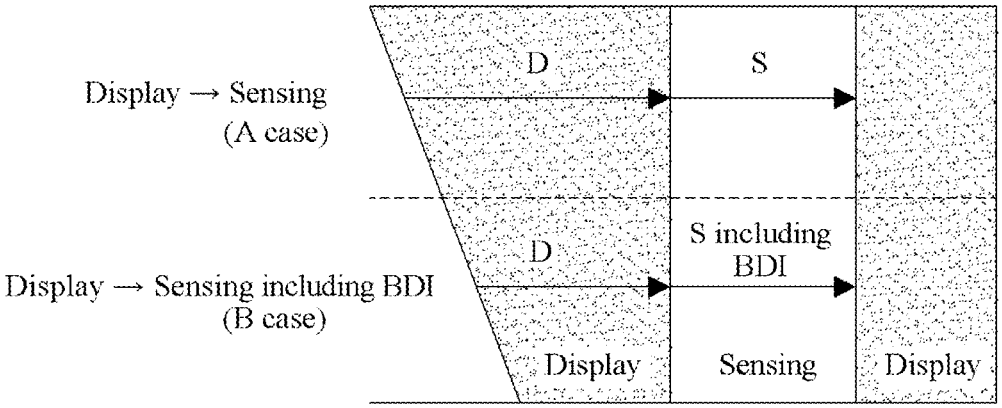
FIG. 2 is a diagram to assist in the explanation of a black image insertion function in the source driver in accordance with the embodiment.

The display period may be set for each frame which forms a driving image, and the sensing period may be set between display periods. In FIG. 2 to be described later, the display period is denoted by "D" and the sensing period is denoted by "S."

In the embodiments, the sensing period may include a sampling period and a conversion period. The sampling period may be defined as a period in which signals of the pixels of the display panel are sensed and sampled to sense characteristic values of the pixels, and the conversion period may be defined as a period in which sampling signals generated by sensing the pixels are converted into digital signals.

In the embodiments, a black image insertion period may be defined as a period in which a black image is inserted between driving images in order to reduce motion blur in a display device.

In the embodiments, the black image insertion period may be included in the sensing period. In more detail, the black image insertion period may be included in the sampling period for sensing and sampling signals of the pixels. For example, the black image insertion period may correspond to a period after signals of the pixels are sensed and sampled, during the sampling period of the sensing period.

In embodiments, terms such as first and second may be used to describe various components, but those components are not limited by the terms. The terms such as first and second may be used only for the purpose of distinguishing one component from the other components.

Figure 1:
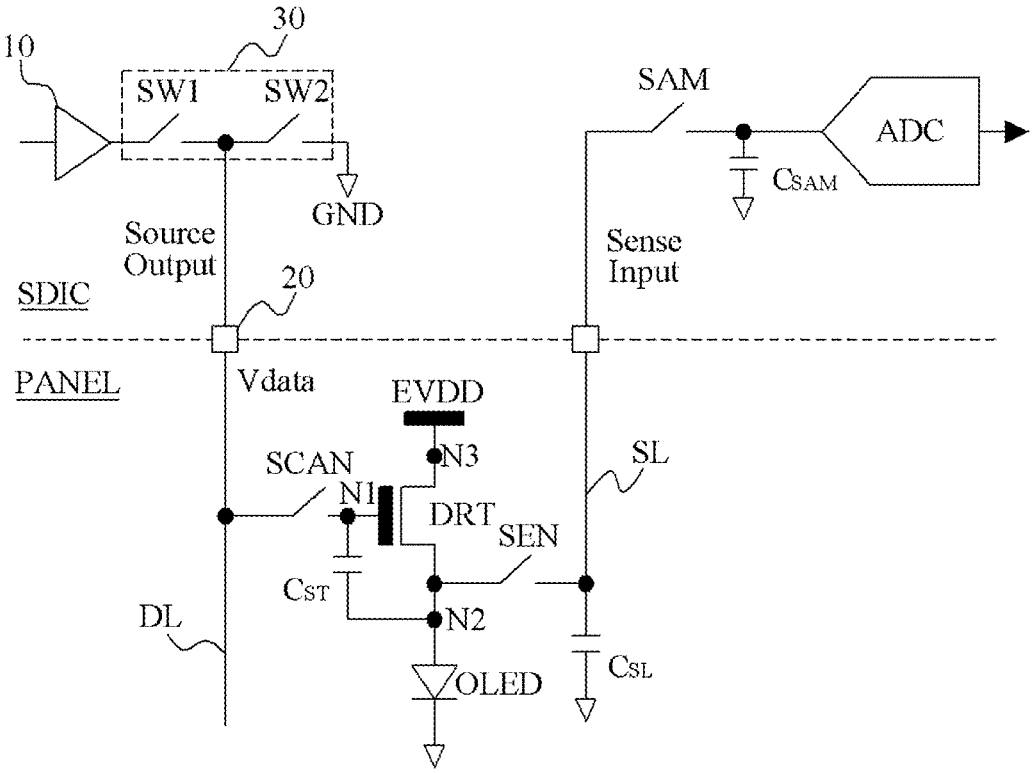
FIG. 1 is a diagram to assist in the explanation of a source driver in accordance with an embodiment and a display device including the same.

FIG. 1 is a diagram to assist in the explanation of a source driver in accordance with an embodiment and a display device including the same.

The display device may include a display panel PANEL, a source driver SDIC, and a timing controller (not illustrated).

The display panel PANEL may include a plurality of gate lines (not illustrated), a plurality of data lines DL and a plurality of pixels. The pixels may be disposed at regions where the gate lines and the data lines DL intersect with each other, and may be connected to sensing lines SL.

Although FIG. 1 illustrates only one pixel for the sake of convenience in explanation, the embodiment is not limited thereto. Each pixel may include a driving transistor DRT, a scan transistor SCAN, a sensing transistor SEN, a storage capacitor CST and an organic light emitting diode OLED. Control signals for switching the scan transistor SCAN and the sensing transistor SEN may be provided through the gate lines.

The driving transistor DRT may have a first node N1, a second node N2 and a third node N3.

The scan transistor SCAN may be connected to the first node N1 of the driving transistor DRT. When the scan transistor SCAN is turned on, a source output Vdata may be applied to the first node N1 through the data line DL.

An anode electrode of the organic light emitting diode OLED may be connected to the second node N2 of the driving transistor DRT, and a driving voltage terminal EVDD may be connected to the third node N3 of the driving transistor DRT.

The storage capacitor CST may be formed between the first node N1 and the second node N2 of the driving transistor DRT, and may maintain a level of the first node N1 at a level of the source output Vdata.

In the above, it may be understood that the source output Vdata is a signal which is outputted through a source output terminal 20 and is a signal which is provided to the data line DL from a switch circuit 30 of the source driver SDIC to be described later.

The timing controller may convert data, received from a host system, into a data type usable in the source driver SDIC, may provide display data and reference data to the source driver SDIC, and may control the operation of the source driver SDIC.

The timing controller may provide the display data to the source driver SDIC during the display period, and may provide the reference data to the source driver SDIC during the sensing period. The reference data may be defined as data which has a preset value in correspondence to the sensing period.

The timing controller may receive digital data corresponding to characteristics of the pixels of the display panel PANEL from the source driver SDIC, and may correct the display data using the digital data.

The source driver SDIC may receive the display data or the reference data from the timing controller, may convert the display data or the reference data into a source signal of an analog type, and may provide the source signal as the source output Vdata to the data line DL of the display panel PANEL.

The source driver SDIC may include a latch circuit (not illustrated), a digital-to-analog converter (not illustrated), and an output buffer 10. The source driver SDIC may further include a sensing circuit for sensing and sampling a signal of a pixel received through the sensing line SL. The sensing circuit may include a sampling switch SAM, a sampling capacitor CSAM and an analog-to-digital converter ADC.

The latch circuit may latch the display data, the analog-to-digital converter may convert the display data into the source signal, and the output buffer 10 may output the source signal.

In the sensing circuit, the sampling switch SAM and the sampling capacitor $C_{SAM}$ may sense and sample a signal of the sensing line SL, and the analog-to-digital converter ADC may convert a sampling signal of the sampling capacitor $C_{SAM}$ into digital data.

The source driver SDIC may provide a black image signal as the source output Vdata to the data line DL of the display panel PANEL during the black image insertion period of the sensing period in order to reduce motion blur. The black image signal is a signal which has a preset voltage level to insert a black image. For example, a ground voltage may be provided as the black image signal.

In detail, the source driver SDIC may provide the source output Vdata corresponding to the reference data to the data lines DL of the display panel PANEL from a first time t1 of the sampling period to a second time t2 of the sampling period when the black image insertion period starts, during the sensing period. In this case, the source output Vdata of the source driver SDIC may be understood as the source signal of the output buffer 10 corresponding to the reference data. In the embodiment of the present disclosure, the first time t1 may be set as a time at which the sampling period starts. The sampling period, the first time t1 and the second time t2 may be understood with reference to FIG. 4 to be described later.

During the black image insertion period of the sensing period, the source driver SDIC may connect a ground terminal GND and the source output terminal 20, and thereby, may provide the ground voltage as the black image signal to the data line DL of the display panel PANEL. In this case, the source output Vdata of the source driver SDIC may be understood as the ground voltage as the black image signal.

In order for the switching of the source output Vdata described above, the source driver SDIC may include a switch circuit 30, and the switch circuit 30 may be configured among an output terminal of the output buffer 10, the ground terminal GND and the source output terminals 20.

The output buffer 10 buffers and outputs the source signal corresponding to the reference data from the first time t1 of the sampling period to the second time t2 of the sampling period when the black image insertion period starts, during the sensing period. The source signal of the output buffer 10 may be outputted to the source output terminal 20 according to the switching of the switch circuit 30.

The ground voltage as the black image signal is applied to the ground terminal GND. The ground voltage may be outputted to the source output terminal 20 according to the switching of the switch circuit 30 during the black image insertion period of the sensing period.

The source output terminal 20 may be connected to the data line DL of the display panel PANEL, and may receive the source signal of the output buffer 10 or the ground voltage of the ground terminal GND according to the switching of the switch circuit 30. A signal received in the source output terminal 20, that is, a signal applied to the data line DL, is the source output Vdata.

The switch circuit 30 may connect one of the output terminal of the output buffer 10 and the ground terminal GND to the source output terminal 20.

The switch circuit 30 may connect the output terminal of the output buffer 10 to the source output terminal 20 from the first time t1 when the sampling period starts to the second time t2 when the black image insertion period starts, and may output the source signal of the output terminal of the output buffer 10 corresponding to the reference data, as the source output Vdata.

During the black image insertion period, the switch circuit 30 may connect the ground terminal GND to the source output terminal 20, and thereby, may output the ground voltage of the ground terminal GND as the source output Vdata.

The switch circuit 30 may maintain the connection between the ground terminal GND and the source output terminal 20 during the conversion period in which sampling signals for signals of the pixels of the display panel PANEL are converted into digital signals.

When the sensing period ends and the display period starts, the switch circuit 30 may turn off the connection between the ground terminal GND and the source output terminal 20, and may turn on the connection between the output terminal of the output buffer 10 and the source output terminal 20.

The switch circuit 30 may include a first switch SW1 and a second switch SW2.

The first switch SW1 may connect the output terminal of the output buffer 10 and the source output terminal 20, and the second switch SW2 may connect the ground terminal GND and the source output terminal 20. When the first switch SW1 is turned on, the second switch SW2 may be turned off, and when the second switch SW2 is turned on, the first switch SW1 may be turned off.

When the sensing period does not include the black image insertion period, the switch circuit 30 may maintain the connection between the output terminal of the output buffer 10 and the source output terminal 20 during the sensing period.

When the sensing period includes the black image insertion period, the switch circuit 30 may connect the output terminal of the output buffer 10 to the source output terminal 20 from the first time t1 when the sampling period starts to the second time t2 when the black image insertion period starts. During the black image insertion period and the conversion period, the switch circuit 30 may connect the ground terminal GND and the source output terminal 20.

FIG. 2 is a diagram to assist in the explanation of a black image insertion function in the source driver SDIC in accordance with the embodiment. Hereinafter, the black image insertion period is denoted by "BDI."

Referring to FIG. 2, there may be a case in which the sensing period does not include the black image insertion period BDI (A case) and a case in which the sensing period includes the black image insertion period BDI (B case).

In detail, in order to reduce motion blur, an organic light emitting display device may perform a black image insertion driving of inserting a black image through pixels other than pixels on which image data is displayed and thereby reducing a motion picture response time (MPRT).

The black image insertion driving is a technology of displaying a driving image on the display panel PANEL by supplying the source signal corresponding to display data through data lines DL and displaying a black image through the other data lines DL or pixels to which the source signal is not applied.

The black image insertion driving is to improve image quality by preventing an image blurring phenomenon by displaying a driving image and a black image in the same frame.

Such a black image insertion driving may be performed during the sensing period in which characteristics of the pixels are sensed, due to time limitations in image driving and sensing driving.

The source driver SDIC may differently control the switching state of the switch circuit 30 in the case A in which the sensing period does not include the black image insertion period BDI and the case B in which the sensing period includes the black image insertion period BDI.

Figure 3:
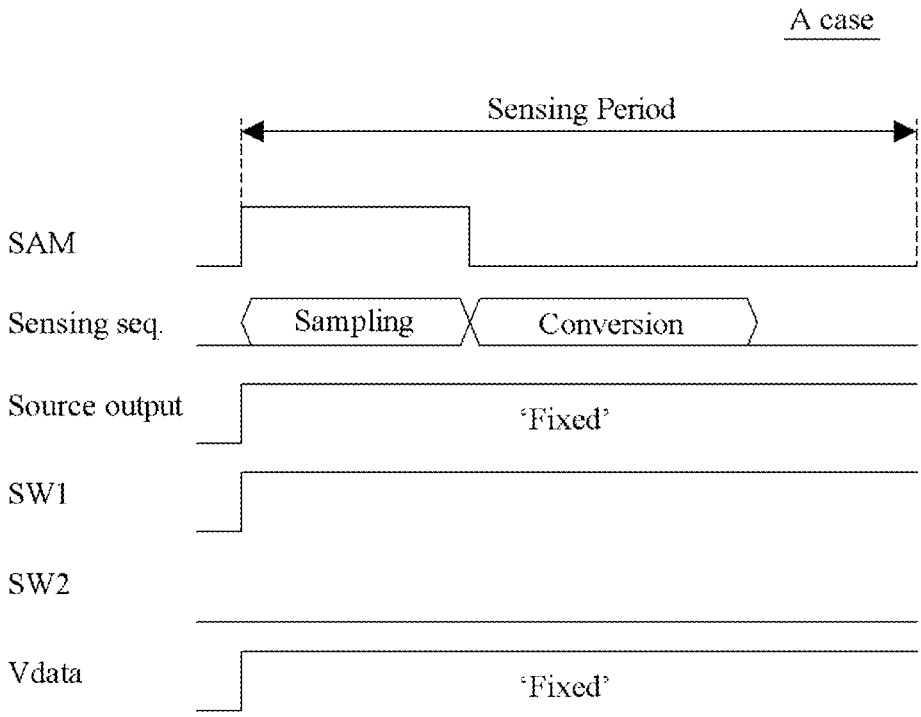
FIG. 3 is a timing diagram for a case in which no black image is inserted in FIG. 2.

FIG. 3 is a timing diagram for the case A in which the sensing period does not include the black image insertion period BDI in FIG. 2.

Referring to FIG. 3, during the sensing period, the source driver SDIC may turn on the first switch SW1 and turn off the second switch SW2, and thereby, may connect the output terminal of the output buffer 10 and the source output terminal 20.

At this time, the source signal of the output buffer 10 maintains a level corresponding to the reference data. The source output Vdata applied to the data line DL through the source output terminal 20 maintains the same level as the source signal. In other words, in the case A of FIG. 3, the source signal outputted from the output buffer 10 may maintain a fixed level without a transition.

Figure 4:
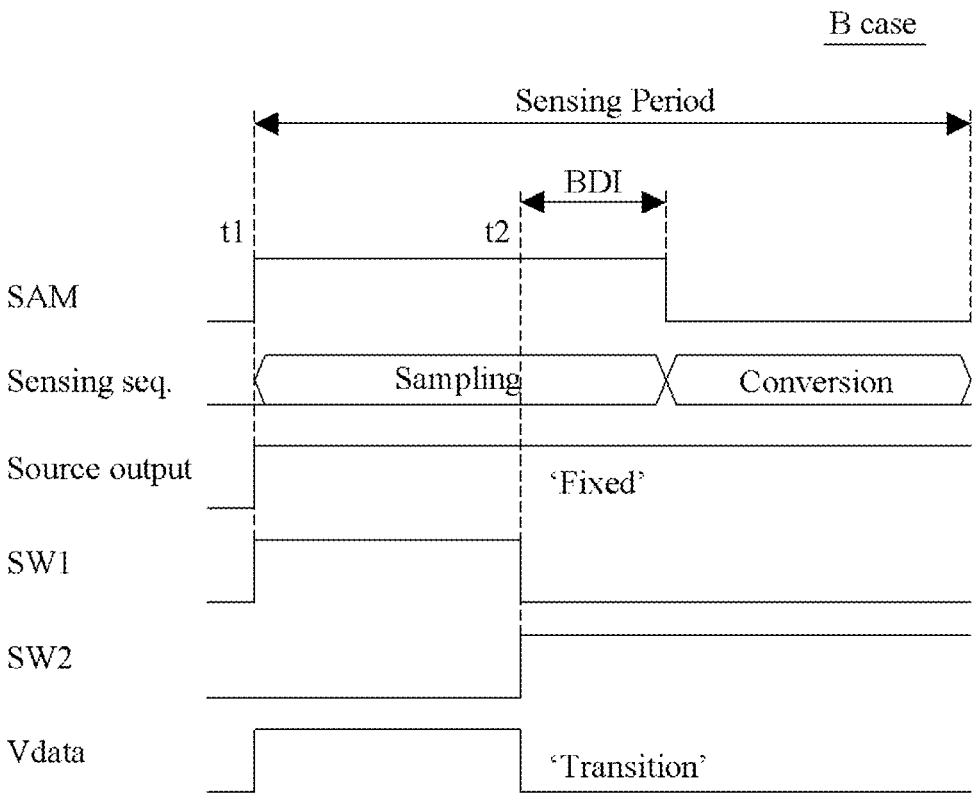
FIG. 4 is a timing diagram for a case in which a black image is inserted in FIG. 2.

FIG. 4 is a timing diagram for the case B in which the sensing period includes the black image insertion period BDI in FIG. 2.

Referring to FIG. 4, from the first time t1 when the sampling period of the sensing period starts to the second time t2 when the black image insertion period starts, the source driver SDIC may turn on the first switch SW1 and turn off the second switch SW2, and thereby, may connect the output terminal of the output buffer 10 and the source output terminal 20. At this time, the output buffer 10 of the source driver SDIC outputs the source signal corresponding to the reference data.

From the first time t1 to the second time t2, the source signal is provided to the source output terminal 20 by the turn-on of the first switch SW1, and the source output Vdata is outputted at the same level as the source signal.

During the black image insertion period BDI and the conversion period after the second time t2, the source driver SDIC may turn off the first switch SW1 and turn on the second switch SW2, and thereby, may connect the ground terminal GND and the source output terminal 20.

During the black image insertion period BDI and the conversion period after the second time t2, the ground voltage is provided to the source output terminal 20 by the turn-on of the second switch SW2, and the source output Vdata is outputted at the same level as the ground voltage. The source signal of the output buffer 10 of the source driver SDIC maintains a fixed level corresponding to the reference data without a transition.

In the embodiment described above, the source signal of the output buffer 10 may maintain a fixed level without a transition even when a black image is inserted during the sensing period. Therefore, the source driver SDIC in accordance with the embodiment of the present disclosure may prevent noise due to a transition of the source signal from being introduced into the sensing circuit during a sensing operation. Therefore, good sensing accuracy may be secured.

Further, due to the fact that the source signal of the output buffer 10 maintains a fixed level without a transition, the above-described embodiment may reduce sensing deviations of characteristic values between the sensing period of the case A with no black image insertion and the sensing period of the case B with black image insertion, thereby improving sensing accuracy.

Moreover, the above-described embodiment does not need to change the source output depending on a period when inserting the black image, thereby simplifying a process for the timing controller to control the source driver.

What is claimed is:

1. A display device comprising:

a display panel; and a source driver configured to provide a source output to a pixel of the display panel, wherein the source driver provides the source output corresponding to a reference data from a first time when a sampling period of a sensing period, in which a pixel of the display panel is sensed, starts to a second time when a black image insertion period starts during the sampling period, and wherein the source driver provides the source output corresponding to a preset voltage level for displaying a black image during a black image insertion period of the sampling period.

2. The display device according to claim 1, wherein the source driver comprises:

an output buffer configured to output a source signal;

a voltage terminal applied with the preset voltage level;

a source output terminal connected to a data line of the display panel; and a switch circuit configured to connect one of an output terminal of the output buffer and the voltage terminal to the source output terminal.

3. The display device according to claim 2, wherein the switch circuit connects the voltage terminal to the source output terminal during the black image insertion period of the sensing period.

4. The display device according to claim 3, wherein the switch circuit maintains connection of the voltage terminal and the source output terminal during a conversion period in which a sampling signal generated by sensing the pixel is converted into a digital signal.

5. The display device according to claim 2, wherein the switch circuit connects the output terminal of the output buffer and the source output terminal from the first time to the second time when the black image insertion period starts, during the sampling period of the sensing period.

6. The display device according to claim 2, wherein the voltage terminal is a ground terminal which provides a ground voltage as a black image signal.

7. The display device according to claim 2, wherein when the sensing period ends and a display period starts, the source driver turns off connection between the voltage terminal and the source output terminal, and turns on connection between the output buffer and the source output terminal.

8. The display device according to claim 2, wherein the switch circuit comprises:

a first switch configured to switch connection of the output terminal of the output buffer and the source output terminal; and a second switch configured to switch connection of the voltage terminal and the source output terminal, wherein the second switch is turned off when the first switch is turned on, and wherein the first switch is turned off when the second switch is turned on.

9. The display device according to claim 2, wherein during the sensing period which includes the black image insertion period, the source driver connects the voltage terminal and the source output terminal during the black image insertion period and a conversion period in which a sampling signal generated by sensing the pixel is converted into a digital signal.

10. A source driver comprising:

an output buffer configured to output a source signal;

a voltage terminal applied with a preset voltage level;

a source output terminal connected to a data line of a display panel; and a switch circuit configured to connect one of an output terminal of the output buffer and the voltage terminal to the source output terminal, wherein the switch circuit connects the output terminal of the output buffer and the source output terminal from a first time when a sampling period of a sensing period, in which a pixel of the display panel is sensed, starts to a second time when a black image insertion period starts during the sampling period, and wherein the switch circuit connects the voltage terminal to the source output terminal during the black image insertion period of the sampling period.

11. The source driver according to claim 10, wherein the voltage terminal is a ground terminal which provides a ground voltage as a black image signal.

12. The source driver according to claim 10, wherein the switch circuit maintains connection of the voltage terminal and the source output terminal during a conversion period, after theft sampling period of the sensing period, in which a sampling signal generated by sensing the pixel is converted into a digital signal.

13. The source driver according to claim 10, wherein when the sensing period ends and a display period starts, the switch circuit turns off connection between the voltage terminal and the source output terminal, and turns on connection between the output terminal of the output buffer and the source output terminal.

14. The source driver according to claim 10, wherein the switch circuit comprises:

a first switch configured to switch connection of the output terminal of the output buffer and the source output terminal; and a second switch configured to switch connection of the voltage terminal and the source output terminal, wherein the second switch is turned off when the first switch is turned on, and wherein the first switch is turned off when the second switch is turned on.

15. The source driver according to claim 10, wherein during the black image insertion period of the sensing period and a conversion period of the sensing period in which a sampling signal generated by sensing the pixel is converted into a digital signal, the voltage terminal and the source output terminal are connected.

* * * * *